US009816478B2

(12) United States Patent
Rapp et al.

(10) Patent No.: US 9,816,478 B2
(45) Date of Patent: Nov. 14, 2017

(54) METHOD FOR REGULATING OR CONTROLLING THE TEMPERATURE OF A SHEATHED-ELEMENT GLOW PLUG

(75) Inventors: Bernd Rapp, Hemmingen (DE); Sascha Joos, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1909 days.

(21) Appl. No.: 12/938,716

(22) Filed: Nov. 3, 2010

(65) Prior Publication Data

US 2011/0127250 A1 Jun. 2, 2011

(30) Foreign Application Priority Data

Nov. 5, 2009 (DE) ..... 10 2009 046 438

(51) Int. Cl.

| | |
|---|---|
| ***F23Q 7/22*** | (2006.01) |
| ***F02P 19/02*** | (2006.01) |
| ***F23Q 7/00*** | (2006.01) |
| *F02D 41/14* | (2006.01) |

(52) U.S. Cl.
CPC ..... *F02P 19/025* (2013.01); *F23Q 7/001* (2013.01); *F02D 2041/1433* (2013.01)

(58) Field of Classification Search
USPC ..... 219/260, 270, 482, 488, 489, 490, 494, 219/497; 123/145 A, 179.5, 179.6
See application file for complete search history.

(56) References Cited

U.S. PATENT DOCUMENTS

| | | | | |
|---|---|---|---|---|
| 4,283,619 | A * | 8/1981 | Abe | 219/492 |
| 6,712,032 | B2 * | 3/2004 | Uhl et al. | 123/145 A |
| 7,234,430 | B2 * | 6/2007 | Toedter et al. | 123/179.6 |
| 7,730,864 | B2 * | 6/2010 | Toedter et al. | 123/145 A |
| 7,950,378 | B2 * | 5/2011 | Casasso et al. | 123/623 |
| 7,957,885 | B2 * | 6/2011 | Kernwein et al. | 701/102 |
| 8,082,090 | B2 * | 12/2011 | Kernwein et al. | 701/102 |
| 2005/0039732 | A1 | 2/2005 | Toedter et al. | |
| 2005/0081812 | A1 | 4/2005 | Toedter et al. | |
| 2009/0316328 | A1 * | 12/2009 | Kernwein et al. | 361/264 |

FOREIGN PATENT DOCUMENTS

| | | | | |
|---|---|---|---|---|
| CN | 1653264 | | 8/2005 | |
| CN | 101555857 | | 10/2009 | |
| JP | 2004-44580 | | 2/2004 | |
| JP | 2005-121017 | | 5/2005 | |
| JP | 5780739 B | * | 9/2015 | F02P 19/025 |

* cited by examiner

*Primary Examiner* — David Angwin
*Assistant Examiner* — John J Norton
(74) *Attorney, Agent, or Firm* — Norton Rose Fulbright US LLP; Gerard Messina

(57) ABSTRACT

A method for regulating or controlling the temperature of a sheathed-element glow plug in a heating phase of the sheathed-element glow plug, where a temperature value is determined as a function of a resistance of the sheathed-element glow plug. To render possible the regulation or control of the temperature of the sheathed-element glow plug also during a transient temperature distribution within the sheathed-element glow plug, the resistance used for determining the temperature value during a transient thermal response within the sheathed-element glow plug is calculated with the aid of a physical model.

5 Claims, 1 Drawing Sheet

METHOD FOR REGULATING OR CONTROLLING THE TEMPERATURE OF A SHEATHED-ELEMENT GLOW PLUG

CROSS REFERENCE

The present application claims the benefit under 35 U.S.C. §119 of German Patent Application No. 102009046438.7 filed on Nov. 5, 2009, which is expressly incorporated herein by reference in its entirety.

FIELD OF THE INVENTION

The present invention relates to a method for regulating or controlling the temperature of a sheathed-element glow plug in a heating phase of the same, where a temperature value is determined as a function of a resistance of the sheathed-element glow plug.

BACKGROUND INFORMATION

Sheathed-element glow plugs, which are used in combustion engines for igniting a fuel-air mixture, are preheated in the cold state until their temperature is high enough to ignite the fuel-air mixture. For that purpose, the sheathed-element glow plug has a heating element which applies an elevated heating voltage to the cold sheathed-element glow plug within a brief time period of one to two seconds, thereby overloading the sheathed-element glow plug at that point in time. Upon completion of this so-called push phase, the tip of the sheathed-element glow plug reaches a temperature of over 1000° C., while the temperature of the remaining portion of the sheathed-element glow plug is still far below this 1000° C. temperature.

The sheathed-element glow plug is normally regulated or controlled by measuring the resistance of a glow filament therein. Since upon completion of the push phase, the remaining portion of the sheathed-element glow plug and thus also the remaining portion of the glow filament have not yet reached the temperature of the tip of the sheathed-element glow plug, a normal temperature regulation or control cannot be performed by measuring the resistance of the glow filament. The transient thermal response, which arises in the sheathed-element glow plug following the push phase, lasts approximately 30 seconds. Subsequently thereto, the temperature in the sheathed-element glow plug equalizes, so that a normal temperature regulation or control can be performed as a function of the measured resistance.

SUMMARY

An object of the present invention is to provide a method for regulating or controlling the temperature of a sheathed-element glow plug in a heating phase of the same, where the regulation or control of the temperature of the sheathed-element glow plug is also possible during a transient temperature distribution within the sheathed-element glow plug.

This objective may be achieved in accordance with an example embodiment of the present invention in that the resistance used for determining the temperature value during a transient thermal response within the sheathed-element glow plug is calculated with the aid of a physical model. An advantage of the example embodiment of the present invention resides in that the glow temperature is modeled very effectively, thereby making it possible to regulate or control the glow temperature at any given point in time of the glow phase, in particular, directly at the start of the combustion engine.

The temperature value is advantageously ascertained as a function of a measured resistance and a calculated resistance value. The measured resistance thereby forms the reliable initial value for calculating the temperature values that are calculated within the time period of the heating phase. It is thus ensured that the temperature values to be ascertained within the heating phase using the calculated resistance values form a reliable basis for regulating or controlling the glow temperature of the sheathed-element glow plug.

In one embodiment, the temperature value is ascertained in a plurality of time intervals, the calculated resistance value changing as a function of the preceding time intervals. This means that a new temperature value is calculated in each case following a predetermined time segment and is used as a basis for the regulation or control. The resistance value to be calculated is advantageously dependent only on the previous time interval and not on the previously determined temperature. This is especially advantageous when working with a transient thermal response, as is present in the heating phase of the sheathed-element glow plug. This procedure eliminates the need for applications that use a thermoelement as a temperature-measuring glow plug, thereby reducing the material costs.

In a further refinement, the calculated resistance value is determined as a function of a decreasing exponential function, the exponents being formed from the thermal relaxation time and a time constant. Thermal relaxation time is understood to be the time it takes for the temperature of the sheathed-element glow plug to reach a steady state following the push phase, thus for the sheathed-element glow plug to achieve a steady-state temperature distribution. Such a transient modeling of the temperature of the sheathed-element glow plug in the heating phase makes it possible to control and regulate the glow temperature as a function of the engine working point, for example, by variably adjusting the load of the combustion engine.

The time constant is advantageously uniquely determined for the sheathed-element glow plug used in the particular case. Since the time constant is glow-plug specific due to production variances, it is already determined following installation of the sheathed-element glow plug in the combustion engine and is stored in a control unit for further use.

In one variant, the first resistance value to be calculated is initialized by a start value. In this context, the start value is multiplied by the exponential function.

In one embodiment, the start value is determined from a difference between a resistance, which is uniquely determined starting from a homogeneous temperature distribution in the sheathed-element glow plug, and a resistance that is detected upon completion of a preheating phase. In the process, it is assumed that the point in time at completion of the preheating phase, which is also referred to as the push phase, is the same as the point in time at the start of the temperature-equalization phase, which is referred to as the heating phase. Thus, the difference is computed from a resistance that is expected upon termination of the heating phase and a resistance that occurs upon completion of the preheating phase at the starting point in time of the heating phase. The resistance is calculated upon completion of the heating phase as a function of the temperature that is reached by the sheathed-element glow plug following the preheating phase and that is calculated from the energy produced by the sheathed-element glow plug, under consideration of the vehicle electrical system voltage to which the sheathed-element glow plug is connected.

In a further refinement, a heating voltage, which is greater than the operating voltage provided for the sheathed-element glow plug, acts upon the cold sheathed-element glow plug during the short-term preheating phase, thereby producing the transient thermal response in the sheathed-element glow plug. This procedure brings the sheathed-element glow plug to a temperature which forms the transient thermal response in the sheathed-element glow plug and which is where the physical model for determining temperature conditions during the heating phase of the sheathed-element glow plug is applied, in which the transient temperature distribution changes to a steady-state temperature distribution along the sheathed-element glow plug.

The resistance value computed for a preceding time segment advantageously forms the starting point for calculating the next resistance value in the following time segment. The calculated resistance values build on one another, whereby the physical model very effectively reproduces the transient thermal response of the sheathed-element glow plug, both in stationary air and at a start of the combustion engine or during idling thereof, as well as in dynamic engine operation in the case that the vehicle is accelerated immediately after start-up of the same. For that reason, the temperature values calculated with the aid of the physical model may be utilized in the regulation or control of the sheathed-element glow plug temperature.

To form the temperature value, one embodiment provides that the resistance of the sheathed-element glow plug be measured upon completion of the preheating phase.

In one variant, the measured resistance is determined from a voltage and a current that are ascertained by measuring a voltage being applied to the sheathed-element glow plug and a current flowing therethrough. Since these parameters may be measured with the aid of the control unit, the resistance is able to be readily calculated from the actual state of the sheathed-element glow plug. However, due to the transient temperature distribution, the resistance will be less than that expected after the heating phase has elapsed.

Once the heating phase of the sheathed-element glow plug has elapsed, in which a steady-state thermal response settles in the sheathed-element glow plug, the temperature is advantageously regulated as a function of a measured resistance value which represents the temperature of the sheathed-element glow plug. It is thus possible to control and regulate the temperature of the sheathed-element glow plug at any time, beginning from the start of the combustion engine, since the actual temperature value is determined with the aid of the physical model during the transient thermal response, while the resistance of the sheathed-element glow plug is measured once the steady-state thermal response has settled, and the actual temperature values for the regulation and/or control are ascertained therefrom.

BRIEF DESCRIPTION OF THE DRAWINGS

The present invention permits numerous specific embodiments. Examples of them will be clarified in greater detail with reference to the figures.

DETAILED DESCRIPTION OF EXAMPLE EMBODIMENTS

At ambient temperatures of <40° C., cold combustion engines, in particular diesel engines, require a starting aid for igniting the fuel-air mixture introduced into the diesel engine. As a starting aid, glow systems are then used that include sheathed-element glow plugs, a glow-time control unit and a glow function software that is stored in an engine control unit. Moreover, glow systems are also used for improving the emissions of the vehicle. Other fields of application of the glow system include a burner exhaust system, an engine-independent heating system, the preheating of fuel (flex fuel), or the preheating of coolant.

Figure 1:
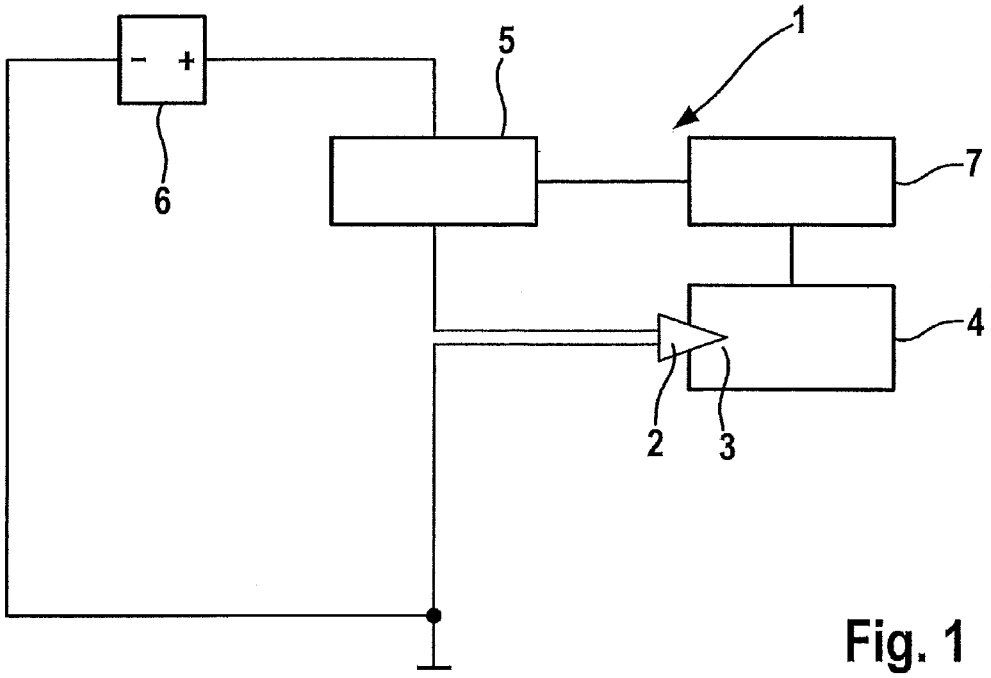
FIG. 1 shows a schematic representation of the configuration of a sheathed-element glow plug in a combustion engine.

FIG. 1 shows such a glow system 1. In this context, a sheathed-element glow plug 2 extends into combustion chamber 3 of diesel engine 4. Sheathed-element glow plug 2 is connected on one side to glow-time control unit 5 and, on the other side, leads to a vehicle system voltage 6 which drives sheathed-element glow plug 2 at the rated voltage of 11 V, for example. Glow-time control unit 5 is connected to engine control unit 7 which, in turn, leads to diesel engine 4.

To ignite the fuel-air mixture, sheathed-element glow plug 2 is preheated by the application of an overvoltage in a push phase which lasts from one to two seconds. The electrical energy, which is thus supplied to sheathed-element glow plug 2, is converted in a heating coil (not shown in greater detail) into heat, which is why the temperature rises steeply at the tip of the sheathed-element glow plug. Glow-time control unit 5 adapts the heating power of the heating coil to the demands of the particular diesel engine 4. The fuel-air mixture is conducted past the hot tip of sheathed-type glow plug 2 and is heated in the process. The ignition temperature of the fuel-air mixture is reached in response to a heating of the intake air during the compressor stroke of diesel engine 4.

Sheathed-element glow plug 2 has different glow phases. As already explained, a push voltage, which is higher than the rated voltage of sheathed-element glow plug 2, is supplied to cold sheathed-element glow plug 2 in a preheating phase, the push phase, which takes one to two seconds. During this brief period of time, the tip of the sheathed-element glow plug is heated to nearly 1000° C., while the remaining portion of sheathed-element glow plug 2 is still at a temperature far below this temperature, thereby producing a transient thermal response within sheathed-element glow plug 2. This preheating phase is followed by a heating phase of sheathed-element glow plug 2, during which the transient temperature distribution changes to a steady-state temperature distribution over entire sheathed-element glow plug 2. Such a heating phase normally lasts for approximately 30 s. During this time period, the temperature of sheathed-element glow plug 2 is not available to a control and/or regulation by engine control unit 7 containing the software for the glow function. Under known methods heretofore, the glow function cannot be regulated until after the steady-state thermal response of sheathed-element glow plug 2 has settled.

Figure 2:
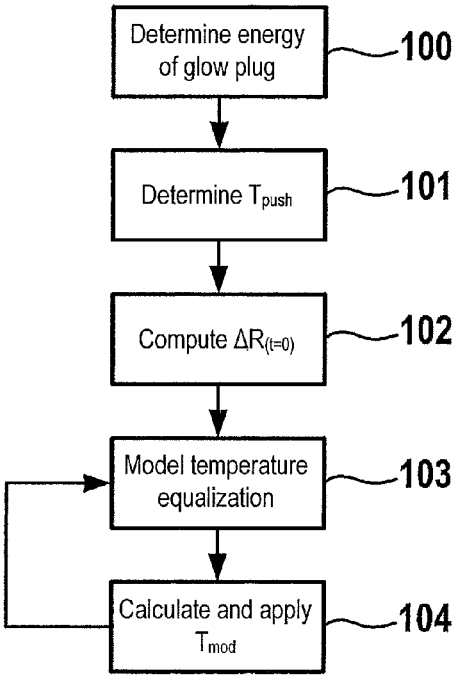
FIG. 2 shows a schematic flow chart for calculating the temperature during the transient temperature distribution.

FIG. 2 is a schematic flow chart for calculating the temperature during the heating phase that is integrated as software in engine control unit 7 or glow control unit 5 and is considered there in the case of a temperature regulation of the glow function of the sheathed-element glow plug.

The energy of sheathed-element glow plug 2 is determined in block 100 by measuring the system voltage of the vehicle which is driven by diesel engine 4, and the current.

The time duration of the push phase is determined as a function of this vehicle system voltage. Block 101 subsequently determines temperature $T_{push}$ reached by the tip of sheathed-element glow plug 2 due to the energy in the form of the push voltage that is made available to sheathed-element glow plug 2 during the push phase.

In light of these preconditions, a resistance differential ΔR(t=0) is computed in block 102.

$$\Delta R_{(t=0)}=R_{(t=30)}-R_{push(t=0)} \quad (1).$$

Alternatively, the resistance values may be directly converted into a temperature. It then holds that:

$$\Delta T_{(t=0)}=T_{(t=30)}-T_{push(t=0)}$$

$$T_{(t=30)} \text{ being}=f(R_{(t=30)} \text{ and } T_{push(t=0)} \text{ being}=f(R_{push(t=0)}).$$

Provided that a steady-state temperature distribution is present, resistance value $R_{(t=30)}$ is uniquely measured following the installation of sheathed-element glow plug 2 in diesel engine 4, and is stored for further calculations. Alternatively, resistance value $R_{(t=30)}$ may be calculated from a resistance model that considers resistance value $R_{(t=30)}$ as a function of temperature $T_{push}$ of sheathed-element glow plug 2 reached in the push phase; as previously explained, temperature $T_{push}$ being a function of the energy made available in the push phase of sheathed-element glow plug 2.

In block 103, the temperature equalization process, which takes place in the heating phase and follows the push phase, is modeled using an exponential formulation under consideration of thermal relaxation time t.

$$T_{mod}=f(R_{meas})+\Delta R(t_K) \quad (2)$$

In the case of a conversion into a temperature, it holds that:

$$T_{mod}=T_{act}+\Delta T(t_K),\ T_{act} \text{ being}=f(R_{meas})$$

$$\Delta R(t_K) \text{ being}=f(\exp(-dt_K/\tau)$$

$$\text{respectively } \Delta T(t_K) \text{ being}=f(\exp(-dt_K/\tau).$$

A resistance $R_{meas}$ is determined which is present at a point in time $t_0$ on glow filament of sheathed-element glow plug. To this end, the voltage being applied to the glow filament of sheathed-element glow plug 2 and the current flowing therethrough are measured, and resistance $R_{meas}$ is calculated therefrom.

Point in time $t_o$($t_o$=^t=0) represents the end of the push phase, but, at the same time, also the beginning of the temperature equalization process, thus of the heating phase.

An initialization is performed in that resistance differential value $\Delta R_{(t=0)}$, respectively temperature differential value $\Delta T_{(t=0)}$ ascertained from equation (1) are multiplied by the exponential function.

$$\Delta R(t_{0+1})=\exp(-dt/\tau)\cdot\Delta R_{(t=0)}$$

$$\text{or } \Delta T(t_{0+1})=\exp(-dt/\tau)\cdot\Delta T_{(t=0)}. \quad (3)$$

In the process, time constant τ forms a quantity to be uniquely defined for each sheathed-element glow plug 2, prior to the use thereof, that is then stored in engine control unit 7. Parameter –dt indicates the time segment of the thermal relaxation (beginning with $t_{(0)}$), at which resistance value $\Delta R(t_{0+1})$ was ascertained). Thus, start value $\Delta R(t_{0+1})$ is obtained, which is inserted into function (2), and first modeled temperature value $T_{mod}$ is thus determined. This modeled temperature value is processed as an actual temperature value in the regulation of the glow characteristics of the sheathed-element glow plug (block 104).

Resistance value $\Delta R(t_K)$ is calculated k-times distributed over the entire heating phase, for example, every 100 ms during the heating phase, in that the most recently calculated resistance value is always multiplied by the exponential function in block 103. From this, the following is derived:

$$\Delta R(t_K)=\exp(-dt_K/\tau)\cdot\Delta R(t_{K-1}) \quad (4)$$

or in the case the resistance value is converted into a temperature $$\Delta T(t_K)=\exp(-dt_K/\tau)\cdot\Delta T(t_{K-1}).$$

Each resistance value $\Delta R(t_K)$, respectively temperature value $\Delta T(t_K)$ is subsequently used in block 104 to calculate temperature $T_{mod}$ for predefined time segment $t_K$ and to utilize the same as an actual temperature value in the regulation during the heating phase.

The described model very effectively reproduces the transient thermal response, both in stationary air and also at the start of the diesel engine or during the idling thereof and may, therefore, be advantageously used for regulating the glow temperature of sheathed-element glow plug 2 in the heating phase.

What is claimed is:

1. A method for regulating or controlling a temperature of a sheathed-element glow plug in a heating phase of the sheathed-element glow plug, comprising:

determining a temperature value as a function of a resistance of the sheathed element glow plug, the heating phase following upon a preheating phase;

when the sheathed-element glow plug is cold, applying a heating voltage to the cold sheathed-element glow plug during the preheating phase, thereby producing a transient thermal response within the sheathed-element glow plug, wherein:

the heating voltage is greater than an operating voltage provided for the sheathed-element glow plug, the temperature value is determined as a function of a measured resistance and a calculated resistance value, the calculated resistance used for determining the temperature value during the transient thermal response within the sheathed element glow plug is calculated with the aid of a physical model, the temperature value is determined in a plurality of time intervals, and the calculated resistance value changes as a function of preceding time intervals;

initializing a first instance of the calculated resistance value by a start value, wherein the start value is determined from a difference between a resistance that is uniquely determined starting from a homogeneous temperature distribution in the sheathed-element glow plug and a measured resistance reached upon completion of the preheating phase; and determining the calculated resistance value as a function of a decreasing exponential function, wherein:

exponents of the exponential function are formed by a thermal relaxation time and a time constant, and the time constant is uniquely determined for the sheathed element glow plug.

2. The method as recited in claim 1, wherein a resistance value computed for a preceding time interval forms a starting point for calculating a next resistance value in a following time interval.

3. The method as recited in claim 1, wherein, to form the temperature value, the measured resistance of the sheathed-element glow plug is measured upon completion of the preheating phase.

4. The method as recited in claim 1, wherein the measured resistance is determined from a voltage and a current that are ascertained by measuring a voltage being applied to the sheathed-element glow plug and a current flowing through the sheathed-element glow plug.

5. The method as recited in claim 1, wherein, once the heating phase of the sheathed-element glow plug has elapsed, in which a steady-state thermal response settles in the sheathed-element glow plug, the temperature is regulated as a function of the measured resistance value that represents the temperature of the sheathed-element glow plug.

* * * * *